US008584365B2

(12) United States Patent
Zeitlin

(10) Patent No.: US 8,584,365 B2
(45) Date of Patent: Nov. 19, 2013

(54) MULTIFUNCTIONAL KNIFE ACCESSORY

(76) Inventor: Eric S. Zeitlin, Baldwin, NY (US)

( * ) Notice: Subject to any disclaimer, the term of this patent is extended or adjusted under 35 U.S.C. 154(b) by 1372 days.

(21) Appl. No.: 12/045,632

(22) Filed: Mar. 10, 2008

(65) Prior Publication Data

US 2009/0223060 A1 Sep. 10, 2009

(51) Int. Cl.
*B26D 7/06* (2006.01)

(52) U.S. Cl.
USPC ..... 30/123; 30/136; 30/169

(58) Field of Classification Search
USPC ..... 30/128, 136, 169, 136.5, 123; 294/50, 294/50.6, 50.7; 15/236.1, 105, 218.1, 15/236.01
See application file for complete search history.

(56) References Cited

U.S. PATENT DOCUMENTS

| | | | | | |
|---|---|---|---|---|---|
| 504,376 | A | * | 9/1893 | Tilman | 30/169 |
| 710,955 | A | * | 10/1902 | Crawford | 30/169 |
| 1,491,623 | A | | 4/1924 | Pitchur | |
| 2,140,209 | A | * | 12/1938 | Rietveld | 15/236.09 |
| 2,651,925 | A | * | 9/1953 | Lawrence | 15/257.1 |
| 3,233,325 | A | * | 2/1966 | Perry | 30/129 |
| 4,361,926 | A | * | 12/1982 | Brush et al. | 15/236.09 |
| 4,569,130 | A | * | 2/1986 | Koller et al. | 30/128 |
| 4,970,749 | A | * | 11/1990 | Priore | 15/236.02 |
| D434,617 | S | * | 12/2000 | Kontou et al. | D7/688 |
| 6,733,056 | B2 | | 5/2004 | Daniele | |
| 7,337,903 | B2 | * | 3/2008 | Lauri | 206/350 |
| 7,740,719 | B2 | * | 6/2010 | Arai et al. | 148/428 |
| 2004/0010923 | A1 | * | 1/2004 | Guiver et al. | 30/233 |
| 2010/0307008 | A1 | * | 12/2010 | Zeitlin | 30/128 |
| 2012/0066914 | A1 | * | 3/2012 | Hayes | 30/312 |

FOREIGN PATENT DOCUMENTS

| | | |
|---|---|---|
| JP | 2002000970 | 1/2002 |
| JP | 2006130278 | 5/2006 |

* cited by examiner

*Primary Examiner* — Omar Flores Sanchez

(57) ABSTRACT

A removably attachable, multifunctional accessory for a utensil such as a kitchen knife is provided comprising a base with at least one cavity, one or more magnets inserted and secured within cavity, and a wing protruding from the base. The wing is shaped in such a fashion as to have minimal effect on normal cutting behavior, and provides several benefits to the user, such as providing means for more easily and accurately guiding piles of cut food around and off a cutting surface, providing means to quickly and more safely remove food remnants stuck to the blade of the knife, and providing means to hold the knife in an upright position.

4 Claims, 12 Drawing Sheets

FIG. 1
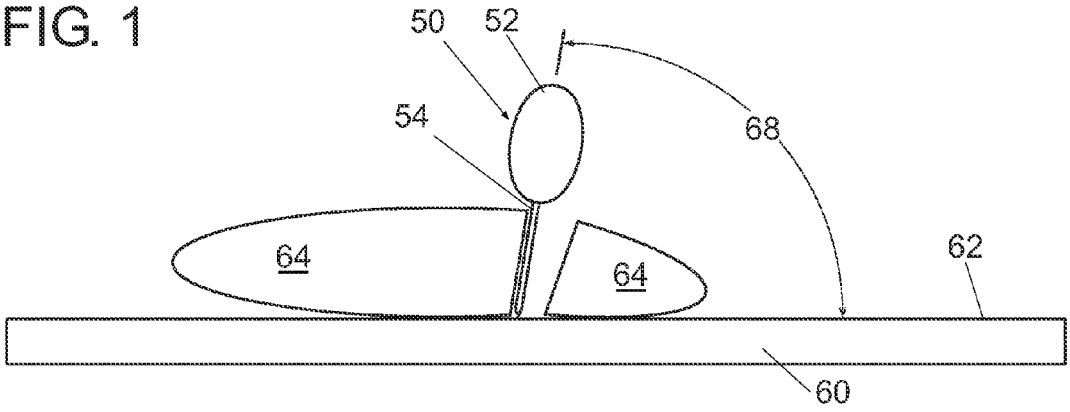
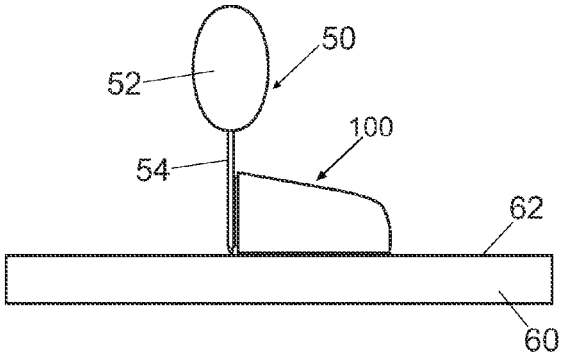
FIG. 2A
PRIOR ART
FIG. 2B
PRIOR ART
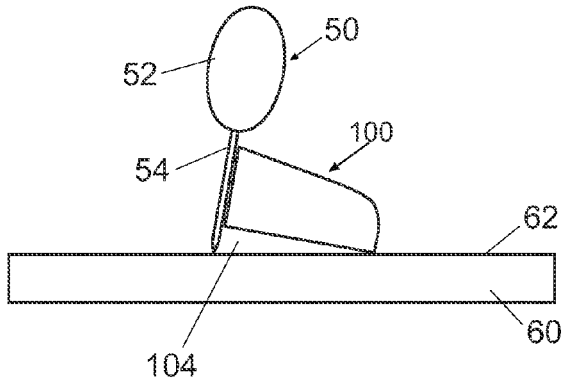

FIG. 4B
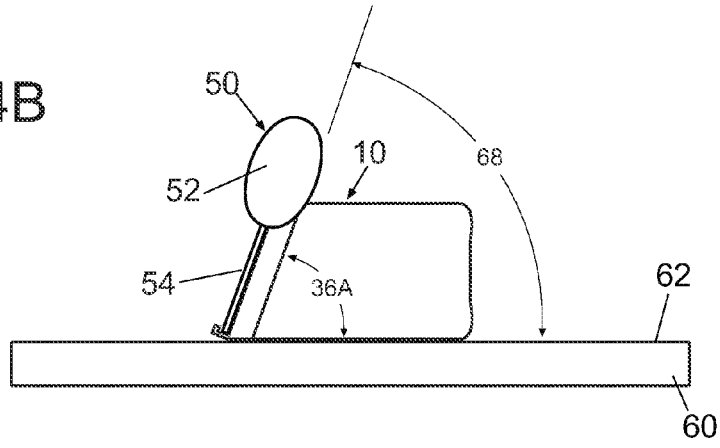
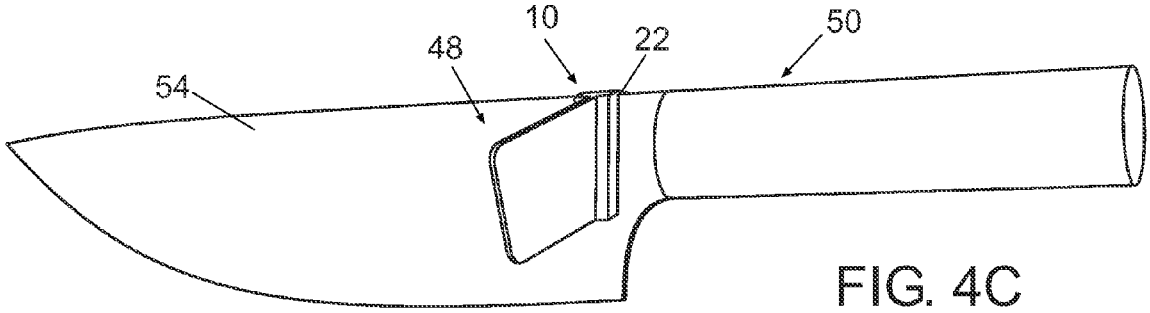
FIG. 4C

FIG. 5D
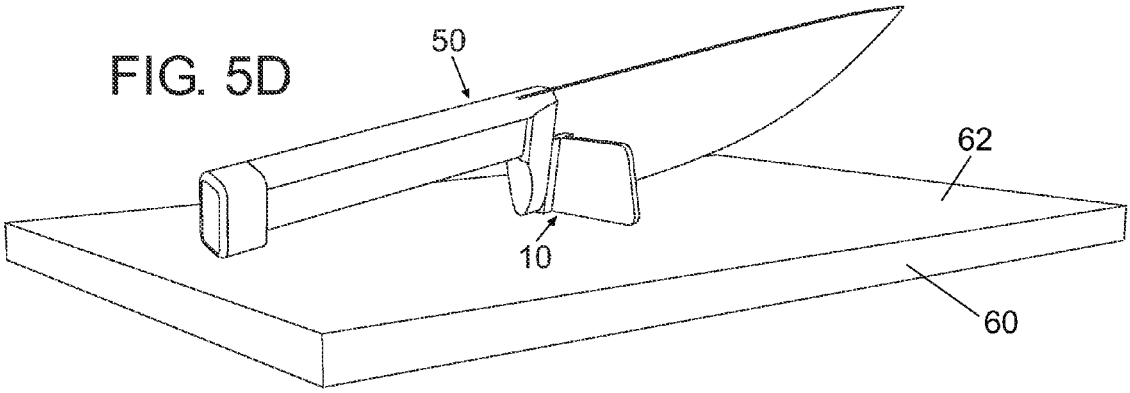
FIG. 6A
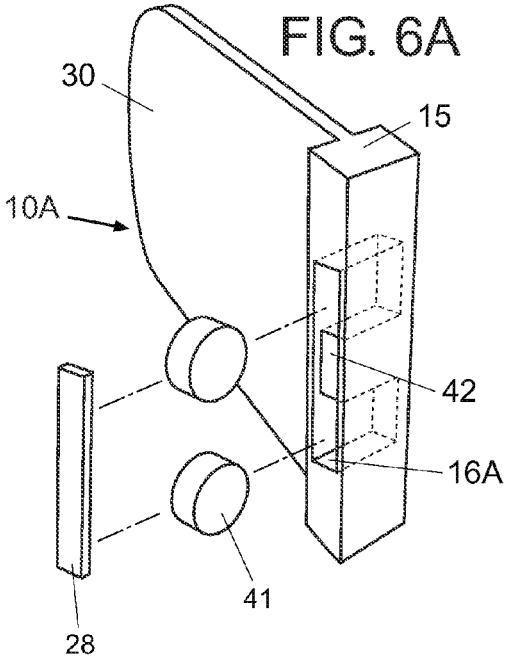
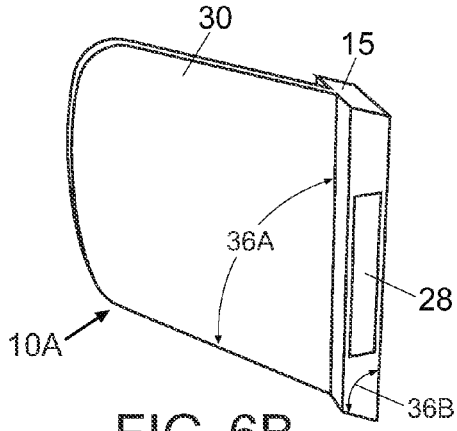
FIG. 6B

FIG. 6C
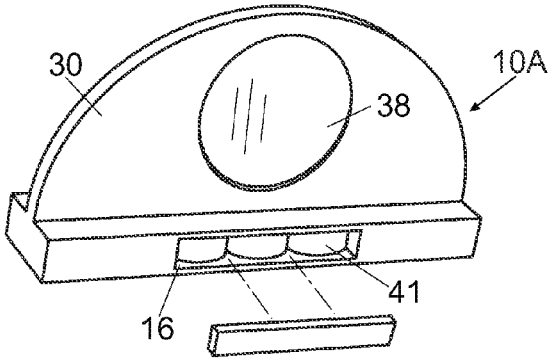
FIG. 6D
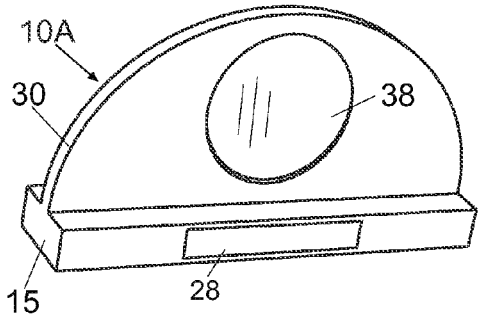
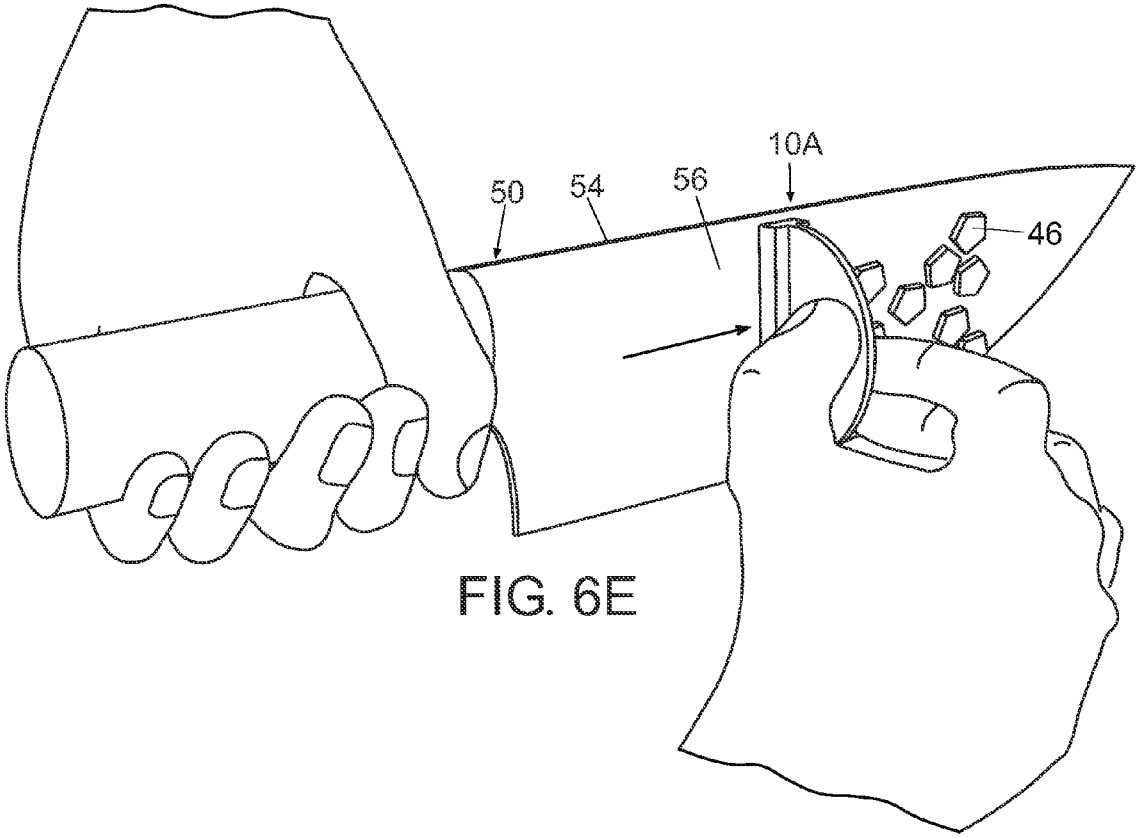
FIG. 6E

MULTIFUNCTIONAL KNIFE ACCESSORY

CROSS REFERENCE TO RELATED APPLICATIONS

N/A

FEDERALLY SPONSORED RESEARCH

N/A

SEQUENCE LISTING OR PROGRAM

N/A

BACKGROUND OF THE INVENTION

1. Field of Invention

This invention relates to knife accessories, particularly to a removably attachable accessory that is used in conjunction with a knife or other utensil to help make food preparation faster, easier, safer, and cleaner.

2. Prior Art

During the process of cutting food into smaller pieces with a kitchen knife and cutting surface such as a cutting board, several problems arise. Firstly, cut-up food often needs to be moved around and off of the board into a container, such as a cooking pot, storage container, or dish. Usually a kitchen knife is used to move the food, however, as a pile of cut-up food is pushed with a knife blade, pieces of food dissipate along the blade instead of staying in a complete pile, because a knife's blade is necessarily straight. This requires multiple scraping movements in multiple directions to effectively move the cut-up food. Additionally, some of the cut-up food ends up where it is not desired, for example on a table, countertop, stove, and floor.

A second problem is removing food remnants stuck to a knife blade after cutting. People often remove the food remnants by running their fingers along the sides of the blade, which is dangerous, and deposits food particles, oils, and residue onto the user's fingers, causing them to smell like the food they are cutting, and may also be detrimental to their health, for example with bacteria from raw meats or irritating oils from onions or peppers, which may cause infection or painful irritation.

Lastly, when a knife is placed down on a surface after cutting food, residue may be transferred from the blade to the surface, requiring extra cleanup. Because the knife is resting on its side, it may be difficult to pick up quickly for subsequent use, since it requires certain dexterity to pick up a knife that is resting on its side. This adds unnecessary time and effort to the food preparation process.

Several products address these problems. Some are scoopers for carrying cut-up food to a container, for example U.S. Pat. No. 6,733,056, to Daniele. They require the user to scrape food into the device with their hand or knife, and often require scraping the inside of the scoop to remove food remnants stuck inside it.

Japanese patent publication number JP2006130278 to Shunichi discloses a squeegee attached to a knife blade, whereby "it becomes possible to rub off from a cutting board more quickly to accuracy" into a bowl. The Shunichi device has several flaws that make it ineffective for the task it aims to perform. For example, it doesn't allow the user to cut or move food with a knife at a natural angle, since a right-handed user will often hold a knife and slice food at an acute angle on the right hand side, between the knife blade and the cutting surface (it is similar for left-handed users on the left-hand side of a knife blade). This is shown in FIG. 1 which shows a back view of a knife 50 cutting through a vegetable such as a cucumber 64, illustrating how a right-handed person would likely cut food with a knife at an acute cutting angle 68 between the right side of knife blade 54 and a cutting surface 62. FIG. 2A illustrates a back view of FIG. 5, a magnetic version, of the Shunichi device 100 attached to knife 50 creating a right-angle between cutting surface 62 and knife blade 54, thereby preventing a user from cutting at a natural, acute angle.

Additionally, there is nothing in the Shunichi invention to prevent it from traveling upwards on a knife blade during cutting and scraping, therefore it will likely be pushed upwards during use, creating a gap 104 between the device and the cutting surface 62, as shown in FIG. 2B, therefore missing some food during corralling. The upward pressure may also cause the device to be pulled off the knife entirely. An external magnet may not be dishwasher safe, and food particles may get caught between the magnet and the device, creating an unsanitary condition, and the magnet may eventually fall off or get pulled off the device. Further, the front bottom corner of the squeegee may catch on the board, which will at best create difficult movement for the user, at worst may cause the device to be pulled off the knife entirely. Additionally, the device won't stay flush with the bottom edge of the knife. The Shunichi application does not mention scraping food off a knife by sliding the device along a blade, nor is it suited for such use, from a practical and safety perspective. Finally, the Shunichi application does not mention using the device to hold a knife upright, nor would it work effectively in that manner.

Some devices address the problem of cut-up food sticking to a knife blade. Santoku knives have scalloped release patterns on their blades to aid the release of thin slices of food sticking to the blade after slicing. Japanese patent publication JP2002000970 to Isao teaches a guide member that is magnetically attached to the blade of a kitchen knife. This device, however, may get in the way of slicing certain foods, and may be inadvertently pushed upwards on the blade during use. The application does not mention sliding the device along a blade to remove food remnants, nor does it provide a safe and efficient means to do so.

U.S. Pat. No. 1,491,623 to Pitchur shows a device used to keep a knife blade off a surface. It would, however, adversely affect cutting food with the knife while it was attached. While the prior art patents provide for some functions related to the problems associated with food preparation, none of these patents take all of the criteria into consideration and provide a single accessory which will provide a useful and convenient accessory for knives.

BACKGROUND OF THE INVENTION—OBJECTS AND ADVANTAGES

Accordingly, several objects and advantages of the present invention are:

(a) to provide a knife accessory that facilitates faster, easier, safer, and cleaner food preparation by providing means for more efficient and accurate moving of piles of cut-up food around and off a cutting board or other surface;

(b) to provide a knife accessory that facilitates faster, easier, cleaner, safer, and more sanitary removal of cut-up food stuck to a knife blade after cutting food;

(c) to provide a knife accessory that facilitates faster, easier, and more sanitary food preparation by providing means for a knife to stand upright between use;

(d) to provide a knife accessory with economical and environmental benefits;

(e) to provide a knife accessory that works effectively with many shapes, sizes, and styles of knives, and is easy to use by people with different cutting styles;

Further objects and advantages will become apparent from a consideration of the ensuing description and drawings.

SUMMARY

In accordance with the present invention, a removably attachable, multifunctional accessory for a utensil such as a kitchen knife is provided comprising a base with a cavity, one or more magnets inserted and secured within that cavity, and a wing protruding outwards from the base. The wing is shaped in such a fashion as to have a minimal effect on normal cutting behavior when the present invention is attached to a knife.

The present invention creates a space between itself and a knife blade that allows easier and more accurate movement of cut-up food around and off a cutting board or other surface, so that when the user is pushing food off the cutting board into a container, the food ends up in the container instead of on the stove, counter, and floor. By sliding the present invention lengthwise along the blade of a knife, it removes food remnants stuck to the blade after cutting. This is faster and safer than the current method, which typically entails the user sliding their finger along the blade to remove the food remnants. The present invention allows the user to place a knife down between use in a safer and more easily accessible position. The device holds a knife upright, with the blade facing downwards, off surfaces, in a position that is much easier to pick up for further use.

DRAWINGS—FIGURES

In the drawings, closely related figures have the same number but different alphabetic suffixes.

FIG. 1 shows a back view of a knife cutting through food, such as a cucumber.

FIG. 2A shows a back view of the device shown in FIG. 5 of the Shunichi application, attached to a knife, in use according to the teachings of the Shunichi application.

FIG. 2B shows a back view of FIG. 5 of the Shunichi invention attached to a knife during use.

FIG. 4B shows a back view of the present invention attached right-side up to a knife.

FIG. 4C shows a perspective view of the present invention attached upside-down to a knife.

FIG. 5D shows a perspective view of a knife being held in an upright position by the present invention.

FIG. 6A shows a perspective exploded view of the back of Alternative Embodiment-A of the present invention, with 35 degree bottom angle, no ledge, and alternate magnet cavity 16A.

FIG. 6B shows a perspective view of the back of Alternative Embodiment-A of the present invention.

FIG. 6C shows a partially exploded perspective view of the back of Alternative Embodiment-A of the present invention, with semi-circular wing and no ledge.

FIG. 6D shows a perspective view of the back of Alternative Embodiment-A of the present invention, with semi-circular wing and no ledge.

FIG. 6E shows a perspective view of Alternative Embodiment-A of the present invention with semi-circular wing and no ledge, removably attached to a knife blade, being used to remove food remnants stuck to the knife blade.

DRAWINGS—REFERENCE NUMERALS

10—Multi-functional Knife Accessory
10A—Alternative Embodiment A
10B—Alternative Embodiment B
15—Base
16—Magnet Cavity
16A—Alternate Magnet Cavity with Magnet Separator 42
18—Left Base Wall
19—Right Base Wall
22—Ledge
26—Ledge Projection
27—Extended Ledge Projection
28—Cavity Cap
30—Wing
30A—Opposing Wing
36A—Wing Angle
36B—Base Bottom Angle

38—Finger Indent
41—Magnets
42—Magnet Separator
44—Food Pile
46—Food Remnants
48—Corralling Area
50—Knife
52—Knife Handle
54—Knife Blade
56—Blade Surface
60—Cutting Board
62—Cutting Surface
64—Vegetable, such as a cucumber
66—Container
68—Acute Cutting Angle
100—Shunichi Device
104—Gap between Shunichi Device and Cutting Surface

Figure 3A:
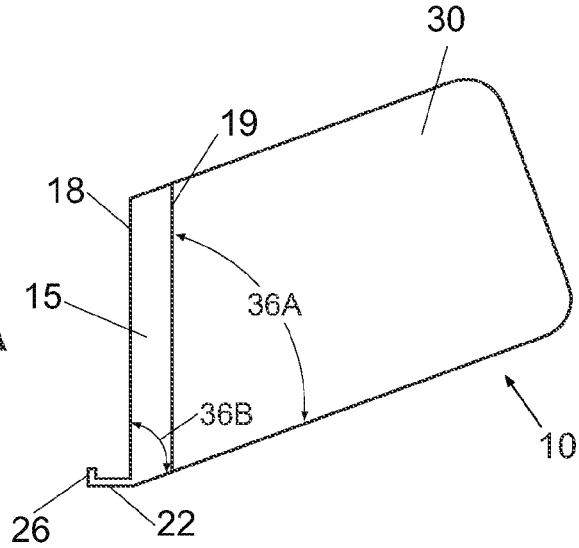
FIG. 3A shows a front view of the present invention.
Figure 3B:
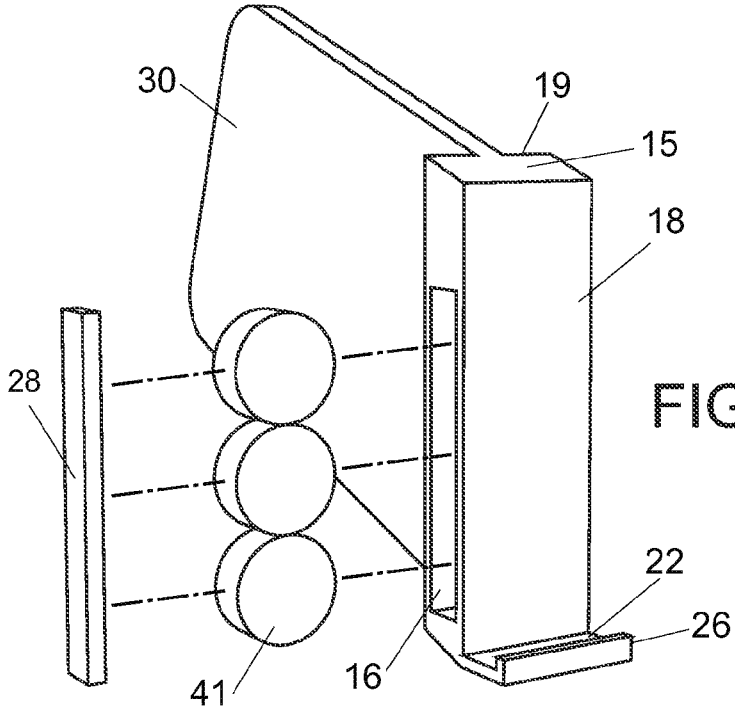
FIG. 3B shows an exploded perspective view of the back side of the present invention.
Figure 3C:
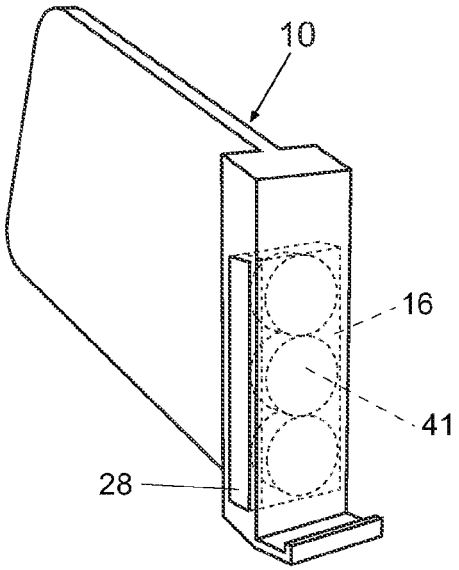
FIG. 3C shows a perspective view of the back side of the present invention.

Detailed Description—Preferred Embodiment—FIGS. 3A-3C

A preferred embodiment of the present invention is illustrated in FIG. 3A which shows a front view of the removably attachable Multifunctional Knife Accessory 10. Accessory 10 is comprised of an elongated base 15 that has a mostly flat ledge 22 perpendicularly protruding outward from the bottom of its left base wall 18. Ledge 22 has an optional ledge projection 26 extending mostly perpendicularly upwards from its end portion. Base 15 also has a wing 30 that protrudes vertically from the approximate center widthwise of right base wall 19, which is more clearly seen in FIG. 3B. From a front view, wing angle 36A is an acute angle formed between the bottom of wing 30 and right base wall 19. The bottom of base 15 is truncated to form bottom base angle 36B, which is formed between the bottom of base 15 and the left base wall 18 and is preferably the same angle as wing angle 36A. The bottom of wing 30 and the bottom of base 15 are therefore mostly in the same plane. Acute angles 36A and 36B allow users to generally cut food at a natural angle while the present invention is attached to their knife.

Although the height of base 15 may vary to the height of wing 30, preferably they are mostly similar, and close to the height of the knife blade they will be attached to, which may also vary. The length of wing 30 may vary, but should be sufficiently long enough to be easily and firmly grasped by the fingers of a human hand, to facilitate easy attachment and removal of the device, and easy sliding of the device along a blade surface. The corners of wing 30 are preferably rounded so as not to gouge a cutting surface during use.

The protruding length of ledge 22 can vary, up to approximately the width of the top edge, or spine, of the knife that accessory 10 is intended to be attached to, to allow it to be used on either the spine or edge of a knife. If use on the spine is not desired, the protruding length need only be long enough to accommodate usage on the edge. I presently prefer that ledge 22 protrude between 1.5 and 3.5 mm from left base wall 18. Ledge 22 should be as thin as possible to have a minimal effect on cutting with a knife that the device is attached to, yet thick enough to maintain its integrity and not break off or get cut-off during use. The height of optional ledge projection 26 can vary, but should be sufficient to prevent accessory 10 from being forced off a knife blade during use. Left base wall 18 should be as thin as possible while still maintaining its integrity, in order to maximize the magnetic attraction between magnets 41 and knife blade 54. Base 15 can be wider relative perpendicularly to wing 30 to provide more stability and safety along blade surface 56, as long as it is still easy to slide along the blade and does not unnecessarily interfere with knife use. Base 12 can have sides that are not straight, for example concave. Angles 36A and 36B may vary, I presently prefer them to be between 40-80 degrees, here shown in the preferred embodiment as approximately 70 degrees.

Base 15 has at least one magnet cavity 16 formed within it, here opening from the back of base 15. One or more magnets 41 are inserted into cavity 16 and subsequently secured there by a variety of methods. In the preferred embodiment, a cavity cap 28 is inserted into cavity 16 subsequent insertion of magnets 41, and secured there with, for example, waterproof glue or a sonic welding process. FIG. 3C shows accessory 10 with magnets 41 secured within, using this method. Another example of how magnets 41 may be secured within cavity 16 is to fill in the remainder of cavity 16 with silicone or sealant after magnets 41 have been inserted into cavity 16. Other methods may also be used that are preferably permanent and heat resistant, and provide watertight coverage of magnets 16. Accessory 10 thus may be washed by hand or in a dishwasher and still maintain the integrity and efficiency of the device.

The shape, size, and depth of cavity 16 may vary to accommodate various shapes, strength, sizes, and quantity of magnets 41 being inserted therein. Multiple cavities may be formed in base 15. Magnets 41 should provide sufficient magnetic strength to securely attach accessory 10 to knife 50 but still allow easy movement along the knife blade, and easy removal from the knife. I presently prefer three nickel-plated neodymium magnets that measure 0.25 inches in diameter, with a thickness of 0.1 inches and strength of at least 35 grade MGO, or a single bar magnet of similar grade with dimensions of 0.25 inches wide by 0.75 inches long by 0.1 inches thick. The strength of magnets 41 may vary depending on the thickness of left base wall 18, the material used to make the device, and other factors of manufacture and use.

I presently prefer the body of the present invention and cavity cap 28 be made of injection molded plastic that will not scratch knives, has strong material strength, is safe for use with food products, is dishwasher safe, and allows maximum magnetic strength to pass through it, for example polypropylene, ABS, or polycarbonate. The present invention may be made of other suitable material or materials, for example stainless steel.

Operation—Preferred Embodiment—FIGS. 4A-5D

Figure 4A:
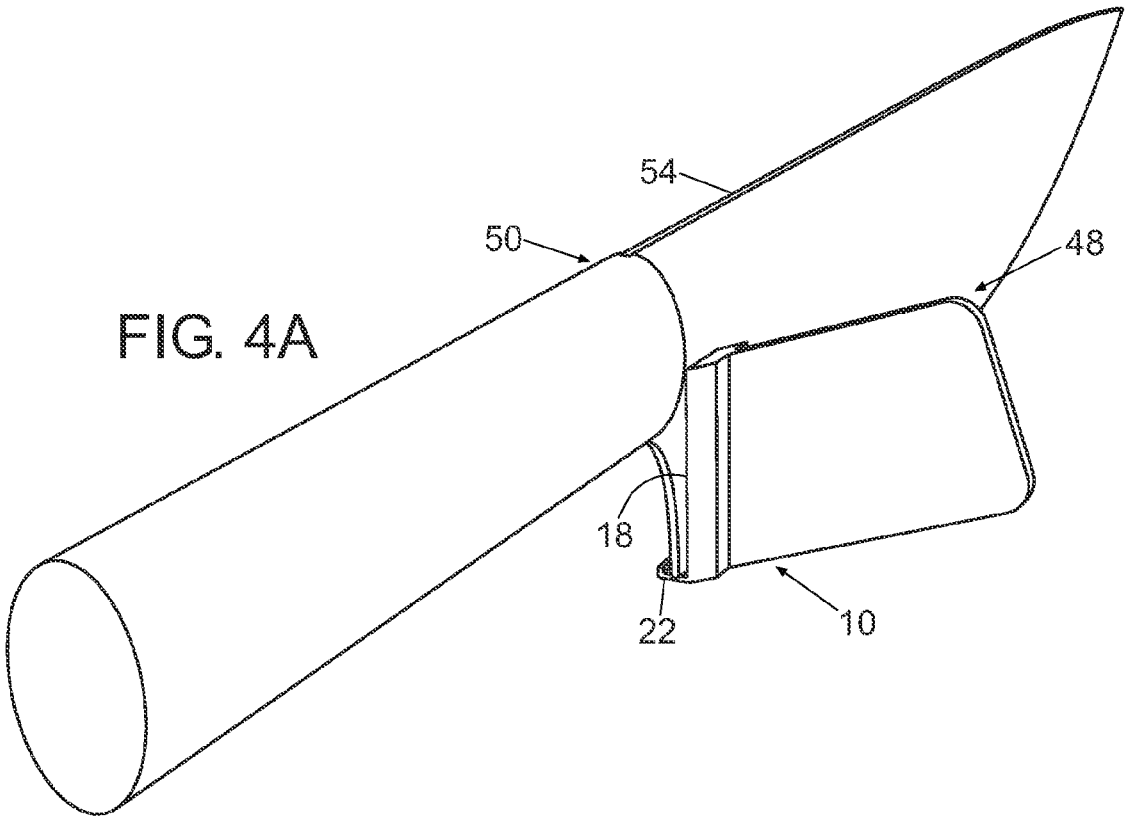
FIG. 4A shows a perspective view of the present invention attached right-side up to a knife.

In operation one uses the present invention by removably attaching it to a knife or other cutting utensil, or any other suitable utensil. Accessory 10 is placed upright onto blade 54 of knife 50 so that left base wall 18 is adjacent blade 54, and ledge 22 is adjacent the bottom edge of blade 54, as shown in FIG. 4A. Magnets 41 removably hold accessory 10 in place there. Typically, accessory 10 is placed towards the back of knife blade 54, forming a corralling area 48 between the back surfaces of accessory 10 and knife blade 54. FIG. 4B is a back view of accessory 10 attached to knife 50 on a cutting board 60, showing how the acute angles of the device allow users to cut at an acute angle 68 while using the present invention removably attached to a knife.

Ledge 22 keeps the bottom of accessory 10 generally level with the bottom edge of knife blade 54 to maintain efficiency of the device, also indicating to the user when the device is correctly in place. Ledge 22 also prevents the present invention from sliding upwards on the blade during use. Another advantage of ledge 22 is that if accessory 10 turns clockwise or counter-clockwise in relation to knife blade 54 during use, it will upright itself when the user next touches the blade edge to a cutting surface, as ledge 22 will get sandwiched between the blade edge and the cutting surface, thereby bringing ledge 22 back into a parallel position relative to the blade edge.

Accessory 10 may be placed on either side of knife blade 54, typically depending on the handedness and preferences of the user. Accessory 10 can also be placed upside down so that ledge 22 is adjacent the spine of knife blade 54, as shown in FIG. 4C. This placement is for those users who turn their knives upside-down to use the spine of the blade to move food along their cutting board. Accessory 10 can be placed elsewhere on the blade, for example the front, or tip of knife blade 54, in which case corralling area 48 is formed between the front surfaces of accessory 10 and knife blade 54.

Figure 5A:
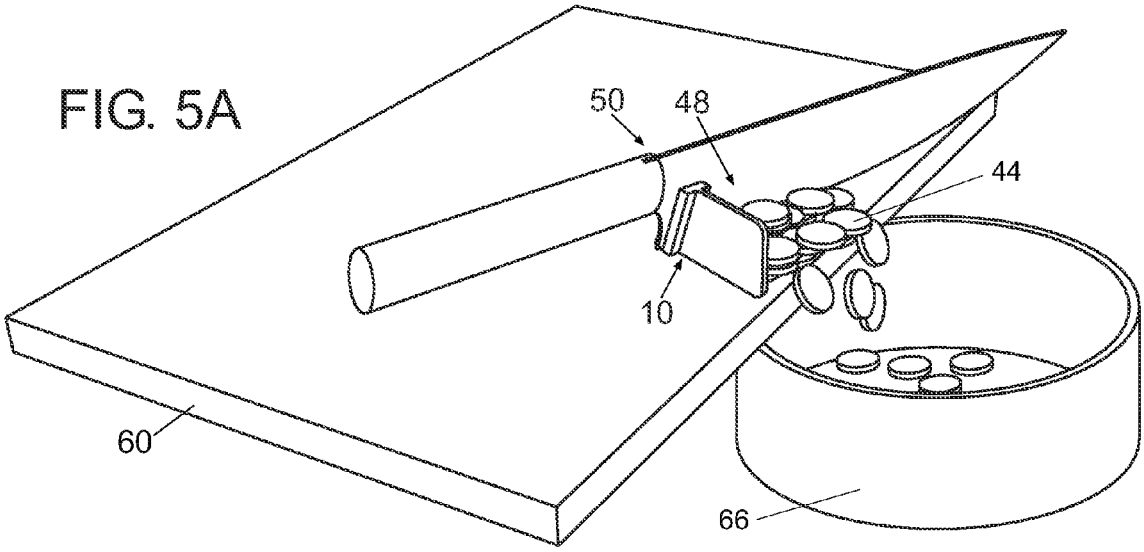
FIG. 5A shows a perspective view of the present invention being used to move food off a cutting board.

With accessory 10 removably attached to knife 50, the user cuts food as they normally would with the knife, typically utilizing a cutting surface such as a cutting board 60, chopping mat, butcher block, etc. When moving food around or off board 60, for example, knife 50 is pushed forward along the board with accessory 10 attached, whereby pieces of cut-up food gather into a pile 44 within corralling area 48. FIG. 5A illustrates how by containing food pile 44 within corralling area 48, the present invention facilitates faster, easier, and more accurate movement and focusing of food pile 44 around and off cutting board 60 into, for example, a container 66, by preventing food pile 44 from dissipating along knife blade 54.

Figure 5B:
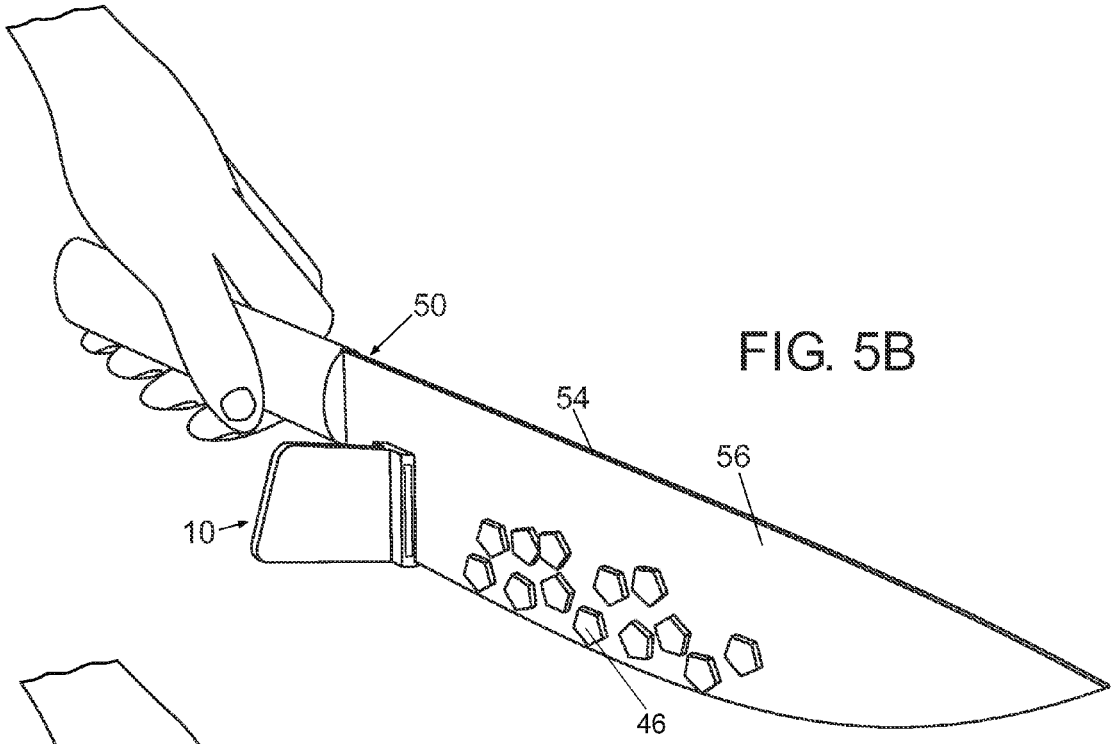
FIG. 5B shows a perspective view of the present invention removably attached to a knife that has food remnants stuck to its blade.
Figure 5C:
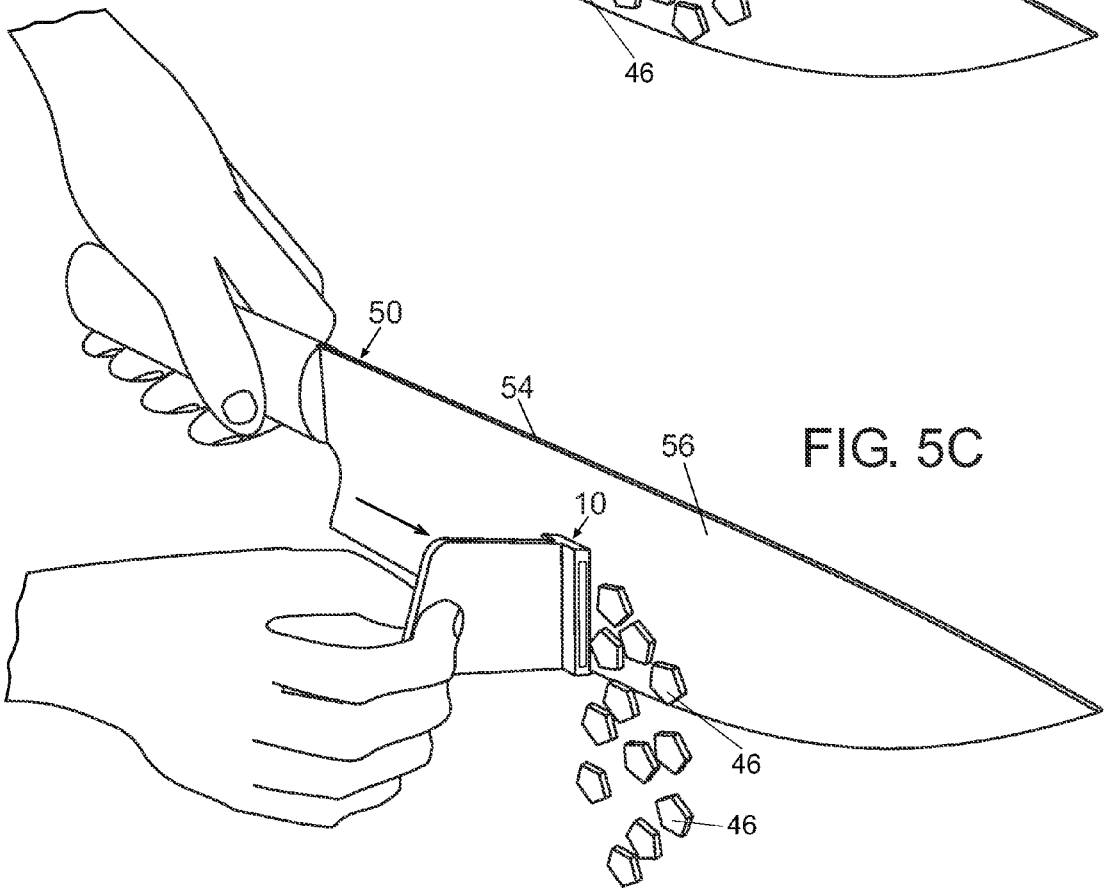
FIG. 5C shows a perspective view of the present invention being used to remove food remnants from a knife blade.

Multifunctional Knife Accessory 10 also facilitates the fast, easy, and safer removal of food remnants 46 that may get stuck to a knife blade 54 after slicing, as shown in FIG. 5B. To remove food stuck to knife blade 54, user slides accessory 10 along the length of blade surface 56, typically in the direction of the arrow, whereby base 15 and wing 30 push food remnants 46 off knife blade 54, as illustrated in FIG. 5C. Accessory 10 may be used to clean off the opposite side of knife blade 54 as well, in a similar manner. User may also wipe-off the blade using the top, bottom, or end of wing 30. Accessory 10 may then be returned to its starting position to continue food preparation. During this process, ledge 22 and ledge projection 26 may be used to help guide accessory 10 along knife blade 54 by traveling adjacently along the bottom edge of knife blade 54. This is especially advantageous if the user is holding knife 50 with their dominant hand while using their non-dominant hand to slide accessory 10 along knife blade 54.

From a top view of the present invention, a T-shape is formed by base 15 and wing 30, where base 15 is the bar of the T and wing 30 is the stem, compared to an L-shape that is formed in a top view of the Shunichi device. A T-shape facilitates sliding the device along the blade from either direction by making it less likely that the device will be inadvertently pulled off the knife during this use, which is especially advantageous for ambidextrous and upside-down use. An L-shaped device of this configuration would be more likely to get pulled off during use, since a stronger lever is produced by the length of the base, and the wing being at one end of the base, instead of in the middle. A T-shape is also safer than an L-shape, because it helps prevent the user's fingers from sliding down both sides of wing 30 past base 15, whereas an L-shaped device only prevents this on one side of the wing; the fingers on the other side may slip past the wing and inadvertently touch the edge of the knife blade, especially if a user's fingers are covered in slippery food residue during food preparation.

Finally, with accessory 10 in place, knife 50 may be put down in a generally upright position, whereby knife handle 52 and accessory 10 rest on surface 62 while blade 54 is substantially off the surface, as illustrated in FIG. 5D. This helps to keep surfaces cleaner and keeps the knife blade from getting contaminated by whatever may be on that surface.

Additionally, by keeping a knife upright, it is faster and easier to pick-up than when it is placed down on its side.

Some people push cut-up food onto a knife blade with their fingers and hands, to be able to carry the food to another location. Accessory 10 may be used to push the food onto the blade instead. When the user is finished using accessory 10, they remove it from Knife 50 for suitable washing and storing. Accessory 10 may be stored by magnetically attaching it to objects containing ferrous material, such as the surface of a refrigerator, freezer, oven, stove, etc.

Description—Alternative Embodiment A—FIGS. 6A-6H

There are many possibilities for alternative and additional embodiments of the present invention. For example, Alternative Embodiment-A 10A, having no ledge 22, facilitates more flexibility for the user in regard to how they may remove food remnants 46 from knife blade 54 with the present invention. FIGS. 6A-6H show embodiment-A 10A with no ledge 22 and various shapes of wing 30, providing various advantages.

FIGS. 6A and 6B show embodiment-A 10A with a 55-degree wing angle 36A and base bottom angle 36B, which can accommodate more users' cutting styles by permitting cutting and corralling of food at a more acute angle, which also decreases the probability that the device will be pushed upwards on a knife blade during use. Depending on the strength of the magnets used and the behavior of users, this embodiment may also be used to corral food and hold a knife upright, in the same manner as the preferred embodiment, as described above.

FIG. 6A shows an exploded view of this embodiment with an alternate magnet cavity 16A with a magnet separator 42, which is a protrusion in the approximate middle of the cavity. Two magnets 41 are inserted into cavity 16A, with magnet separator 42 between them, thus creating two separate magnetic focal points instead of one in the center, which may help prevent the device from rotating on knife blade 54 during use. Alternatively, two individual magnet cavities 16 with two individual cavity caps 28 may be used to achieve a similar effect. FIG. 6B shows this embodiment after magnets 41 have been inserted into alternate magnet cavity 16A and cavity cap 28 secured therein, as described above.

Figure 6F:
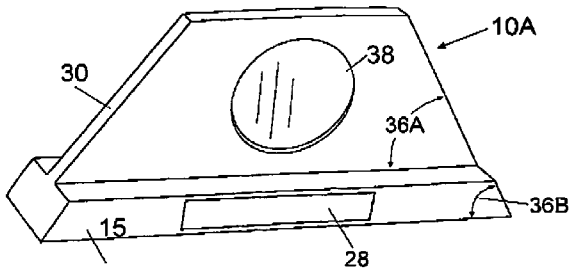
FIG. 6F shows a perspective view of the back of Alternative Embodiment-A of the present invention with truncated semi-circular wing and no ledge.
Figure 6H:
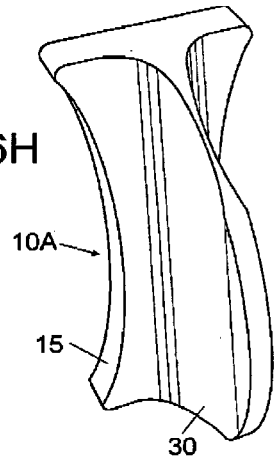
FIG. 6H shows Alternative Embodiment-A of the present invention with no ledge, a semi-circular wing with partially concave sides, and a base with concave sides.
Figure 6G:
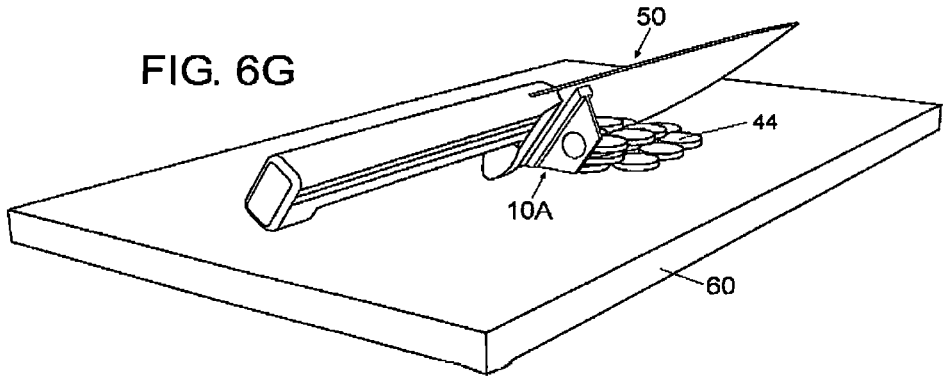
FIG. 6G shows a perspective view of Alternative Embodiment-A of the present invention with truncated semi-circular wing and no ledge, attached to a knife, being used to corral food.

FIGS. 6C-6E show alternative embodiment-A 10A with a semi-circular wing 30. FIG. 6C shows a partially exploded perspective view showing magnets 41 inserted into cavity 16 before being secured there with cavity cap 28, as described above. FIG. 6D shows the device fully assembled. FIGS. 6F-6G show alternative embodiment-A 10A with a truncated semi-circular base 15 and wing 30, with approximately 55-degree angles 36A and 36B. FIGS. 6C-6G show a finger indent 38 which may be placed on one or both sides of wing 30. Indent 38 may be shaped differently than shown, and is one of several methods that may be used to facilitate a better grip on wing 30. FIG. 6F shows Alternative Embodiment-A with wing 30 having 2 straight sides and a straight top. FIG. 6H shows Alternative Embodiment-A with a semi-circular wing 30 with partially concave sides, and a base 15 with concave sides, to illustrate the versatility of design of the present invention. The concave sides of base 15 assist in the capturing and subsequent removal of food remnants 46, while the concave sides of wing 30 help to facilitate a better grip on the wing. Embodiment-A can be used to remove food remnants from a knife blade, it will help to corral food, it selflevels at the users cutting angle, it can be used right-side up or upside down, and may help to keep a knife upright on a surface.

Operation—Alternative Embodiment A—FIGS. 6E and 6G

Embodiment-A 10A is removably attached to knife 50 and used in a similar manner as the preferred embodiment as described above, although there are more options for placement, in that they do not need to be lined up with the edge or spine of blade 54. FIG. 6E shows embodiment-A 10A being used to remove food remnants stuck to knife blade 54 by the user gripping wing 30 with their fingers and sliding the device along knife blade 54, typically in the direction of the arrow. Because it does not have a ledge 22, embodiment-A 10A may be placed at any height on knife blade 54, per user preference, and multiple swipes of both sides of blade 54 may easily be made.

Embodiment-A 10A can be used right-side up, upside-down, and anywhere in between, on both sides or a knife blade. Depending on the particular configuration, it may be used to help guide food piles around and off cutting surfaces, as described above, and as shown in FIG. 6G. It may also be used to hold knives in an upright position, whereby a knife with the present invention removably attached is placed down with the sides or top of wing 30 resting on a surface, depending on the configuration, as described above. Thus, there is much versatility available to this embodiment to accommodate users' behavior variations and preferences. For example, the device may be used solely for removing food remnants from a knife, and may be used to remove food remnants from a knife without being removably attached to the knife first. In that case, embodiment-A 10A may be made without attachment means, such as magnets and magnet cavities, and may be shaped differently, for example having a more elongated base and wing, and may exist as a wing only and still enable the effective removal of food remnants from a knife blade.

Description—Alternative Embodiment B—FIGS. 7A-7D

Figure 7A:
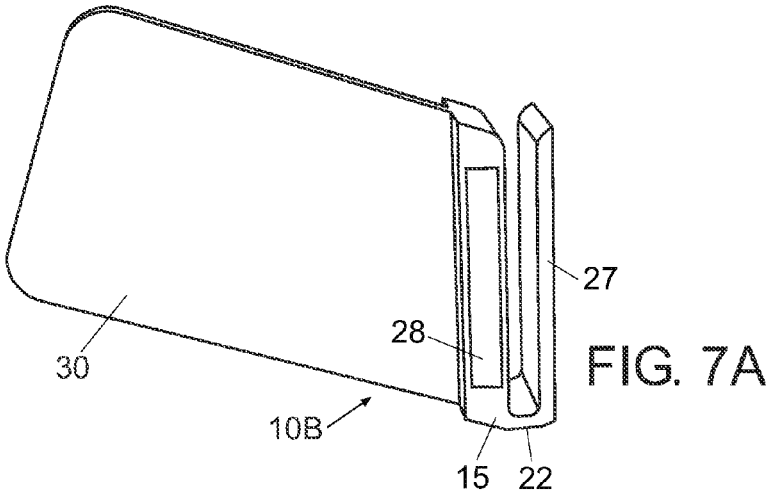
FIG. 7A shows a perspective view of the back of Alternative Embodiment-B of the present invention, with mostly straight vertical extension 27 protruding upwards from the end of ledge 22.

FIG. 7A illustrates Alternative Embodiment-B 10B of the present invention is similar to the preferred embodiment, additionally having an extended ledge projection 27 extending upwards from the end of ledge 22. Projection 27 helps prevent the device from being inadvertently pulled off knife blade 54, and facilitates the cleaning off of the opposite side of knife blade 54 when the user slides embodiment-B 10B along blade 54, whereby food remnants 46 that may be stuck to both sides of blade 54 are removed. Putting radii on the tops of base 15 and projection 27, as shown, makes it easier to attach this variation to a knife blade.

Figure 7B:
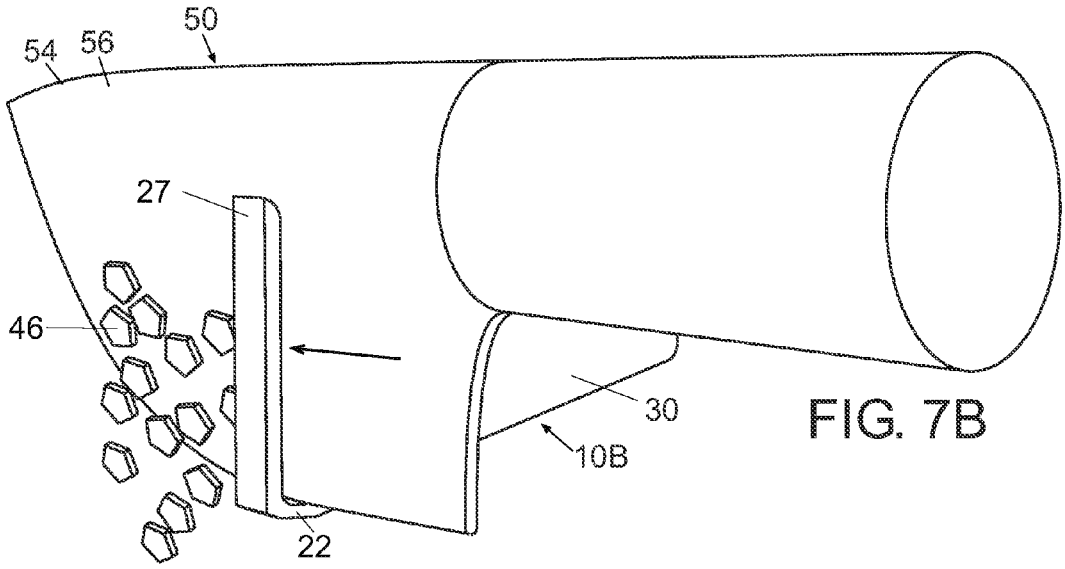
FIG. 7B shows a perspective view of Alternative Embodiment-B of the present invention being used to remove food remnants stuck to a knife blade.
Figure 7C:
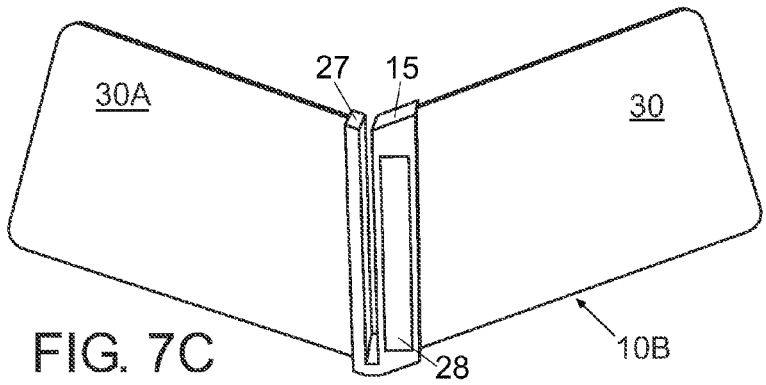
FIG. 7C shows a perspective view of the back of Alternative Embodiment-B of the present invention with two opposing wings.

FIG. 7C illustrates an additional embodiment of alternative embodiment-B 10B of the present invention, having an opposing wing 30A protruding from extended ledge projection 27, opposite wing 30, which allows the user to corral food on both sides of knife 50. It also lets users grasp either wing 30 or opposing wing 30A to move the device. Opposing wing 30A can be shaped and sized differently than wing 30.

Figure 7D:
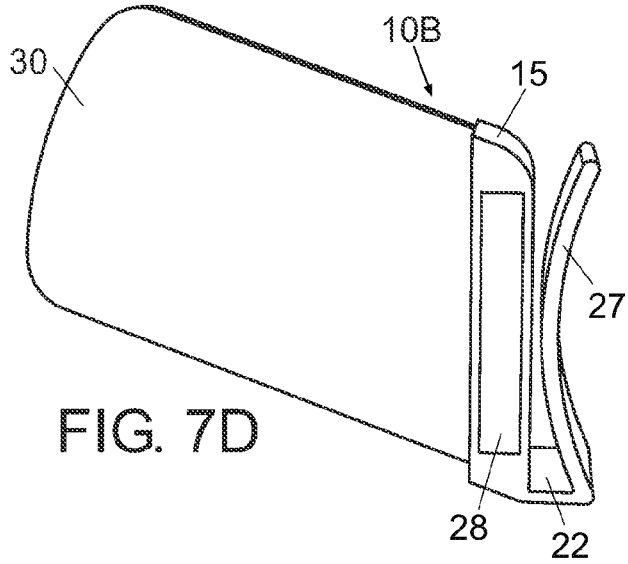
FIG. 7D shows a perspective view of the back of Alternative Embodiment-B of the present invention, with inwardly-curved vertical extension 27 protruding upwards from the end of ledge 22.

If the material of which the device is manufactured has flexible and elastic properties, extended ledge projection 27 may be inwardly-curved instead of mostly straight, as shown in FIG. 7D, creating a form of spring clip, which would also help to hold the device in place on knife blade 54. In this case, the number and/or strength of magnets 41 needed for effective use may be reduced.

Figure 7E:
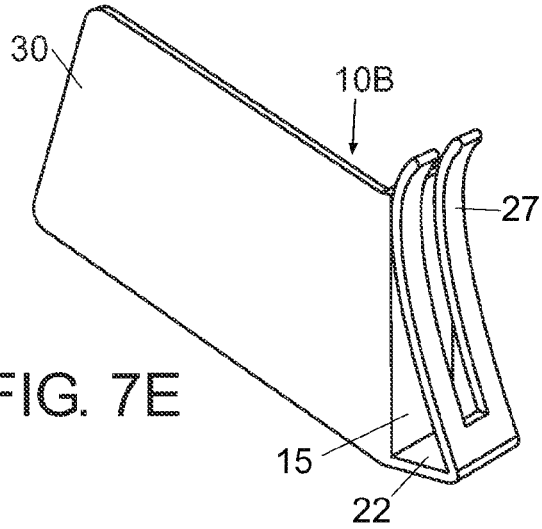
FIG. 7E shows a perspective view of Alternative Embodiment-B of the present invention, with a curved vertical extension 27 protruding upwards from the end of ledge 22, with no magnets or magnet cavity.
Figure 7F:
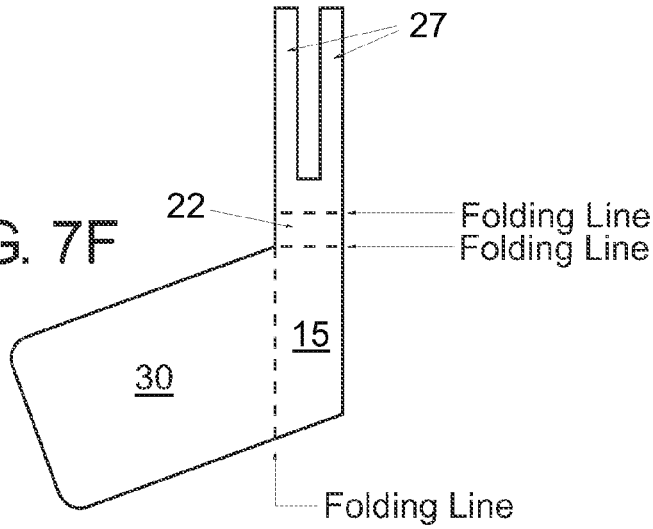
FIG. 7F shows an illustration of a cut-out flat pattern which may be used to create Alternative Embodiment-B of the present invention shown in FIG. 7E.

Depending on the strength of the spring clip that is created, cavity 16 and magnets 41 may be eliminated from the design altogether, relying solely on the spring clip created by an inwardly curved extended ledge projection 27 to removably hold the device on knife blade 54, as shown in FIG. 7E, where embodiment-B 10B is constructed of material with flexible and elastic qualities, for example but not limited to polypropylene or flat spring steel. If made from plastic, it may be easily manufactured with, for example, an injection molding process in the same manner as the preferred embodiment but without magnet cavity 16. If made from flat stock such as spring steel, a pattern such as the one shown in FIG. 7F is cut out and bent to shape, then subsequently processed for maximum spring properties. Alternatively, wing 30, base 15, and ledge 22 may be made of a non-flexible material, and be attached to a separate, inwardly curved extended ledge projection 27 that is made of flexible and springy material. Embodiment-B 10B can be made with only one extended ledge projection 27, or with two or more separate projections 27, as shown in FIGS. 7E-7H.

Operation—Alternative Embodiment B—FIG. 7B

Alternative Embodiment-B 10B works similarly to the preferred embodiment of the present invention, as described above, and additionally, as the device is slid forward along knife blade 54, extended ledge projection 27 removes food remnants 46 off the opposite side of knife blade 54, so that food remnants 46 are removed from both sides of the blade, as shown in FIG. 7B.

Figure 7G:
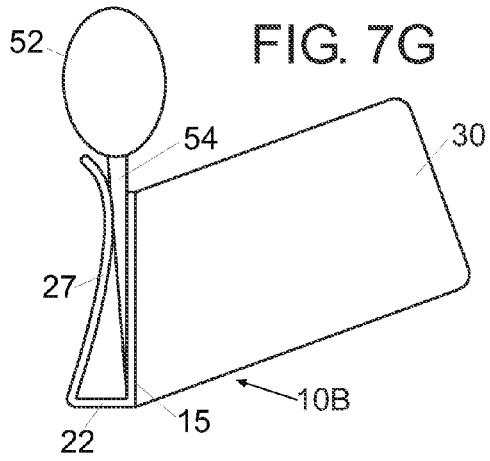
FIG. 7G shows a back view of Alternative Embodiment-B of the present invention shown in FIG. 7E, attached to a knife.
Figure 7H:
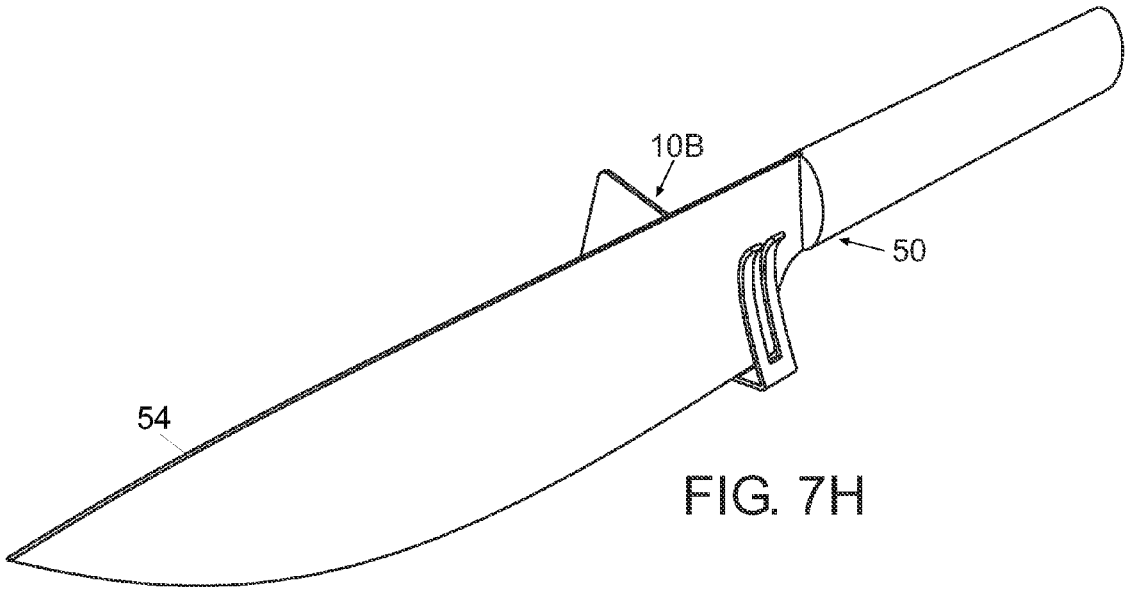
FIG. 7H shows a perspective view of Alternative Embodiment-B of the present invention shown in FIG. 7E attached to a knife.

FIG. 7G shows a back view of embodiment-B 10B with no magnets or magnet cavity, removably attached to knife blade 54, with the upwards portion of extended ledge projections 27 temporarily pushed outwards away from base 15, yet maintaining a movable force pushing against knife blade 54, thus holding the device in place by forcefully sandwiching blade 54 between projections 27 and base 15. Projections 27 may be temporarily pressed away from knife blade 54, but will spring back into place against the blade when released. FIG. 7H shows a perspective view of this embodiment removably attached to knife 50.

Advantages

From the description above, a number of advantages of my multifunctional knife accessory become evident:

(a) The present invention, when used with a knife as described above, facilitates faster and easier food preparation by providing an area 48 between the knife and the device for more accurately and efficiently moving piles of cut-up food around and off a cutting board or other surface. Fewer passes are needed with a knife to effectively move food piles, and less movement may make food preparation less painful for people with problems such as arthritis, repetitive stress injury, carpel tunnel syndrome, etc.;

(b) The present invention facilitates cleaner food preparation by helping to prevent pieces of cut-up food from inadvertently falling off a cutting surface onto the stove, counter, floor, etc. as a user is moving a food pile from a cutting surface to a container, as tends to happen when only a knife is used for that purpose. The present invention saves the user time and energy otherwise needed for cleaning up wayward food, it keeps the kitchen more sanitary, and it saves the user money through less food waste and less use of cleaning materials, which also benefits the environment;

(c) The present invention facilitates faster, easier, and safer removal of cut-up food stuck to a knife blade after cutting, by providing a convenient device for sliding along the blade to remove the stuck food, whereby the user avoids touching the blade with their fingers, and avoids touching cut-up food that could cause bacterial contamination, and cause strong odors and skin irritants from such foods as onion, garlic, and pepper to get on their skin. Additionally, by facilitating faster preparation of foods such as onions, the user has less exposure to the eye irritants contained therein, thereby making food preparation a more pleasant experience;

(d) The present invention facilitates faster, easier, and cleaner food preparation by providing means for a knife to stand upright when put down between use, thereby keeping the knife blade off surfaces. This keeps surfaces cleaner and helps prevent contamination of the blade by dirt or germs on that surface. Additionally, by keeping a knife upright, it is faster and easier to pick up than if it was placed down on its side;

(e) The present invention will removably attach to and fit most knives and work effectively on most knife shapes and styles. The present invention can be placed on either side of a knife blade for use by right-handed and left-handed users, and can be used with either hand, so that the user does not have to switch the knife to their non-dominant hand in order to use the device. It can be placed right-side up or upside-down, on the spine or edge of a knife blade, and anywhere from the back end to the front of a knife blade;

(f) The present invention can be stored when not in use by magnetically attaching it to the surface of a refrigerator, freezer, stove, oven, or other object containing ferrous material;

(g) The present invention is easy to use, easy to learn how to use, and makes cooking more enjoyable and less frustrating. It allows the user to generally maintain their present cutting method and style while using the device. It is easily cleaned by hand or in a dishwasher. It acts as a splash guard when cutting juicy fruits and vegetables, and has a long product life;

(h) By enclosing magnets into the body of a T-shaped device, it will slide better along a knife blade than if the magnets are attached to the outside of the device. The T-shape of the present invention also provides a safer and more stable device.

CONCLUSION, RAMIFICATIONS, AND SCOPE

Accordingly the reader will see that, according to the present invention, I have provided a removably attachable accessory for a utensil such as a kitchen knife that allows the user to cut food items as they normally do, and providing several benefits to the user, including but not limited to providing means for more easily and accurately guiding piles of cut food around and off a cutting surface, providing means to quickly and safely remove food remnants that are stuck to the blade of the knife, and providing means to hold the knife in an upright position. Furthermore, the present invention has the additional advantages that:

It can be coated with Teflon, PTFE, or other non-stick coatings, as well as other coatings to provide various benefits, such as making it slide more easily along blade surface 56. The outer surface of left base wall 18 can be textured, ridged, or otherwise designed to help prevent the device from inadvertently moving upwards on a knife blade;

It can be permanently attached to a cutting utensil or other utensil, or originally made as part of the utensil, or temporarily attached by means other than that already described above, such as with hook-and-loop fasteners, or other mechanical means. It can be used without first removably attaching it to a utensil, by picking it up from its resting place for immediate use;

It can have a knife sharpener or other particular shape and material incorporated into the device that the user can use to sharpen the blades of their knives;

It can be made of materials that increase its strength and resistance to being broken or cut, or otherwise be reinforced to prevent ledge 22 from being severed or broken off from the device. Ledge 22 can be longer or shorter, thicker or thinner than described herein. It can have a groove in it for placement of a blade edge, and may be rounded or otherwise shaped to better accommodate certain blades or usage. Ledge 22 can protrude from base 15 at angles other than 90 degrees;

Various methods may be implemented to make accessory 10 and any embodiment thereof easier for the user to grip and use, for example wing 30 can be textured, ridged, coated, over-molded, grooved, engraved, with inverted or sunken areas, etc.;

Magnets 41 can be placed in base 15 so that they are partially or fully exposed along the outer surface of left base wall 18, using a cavity 16 that is designed to facilitate this exposure. This may provide better adhesion to blade surface 56 and may allow the use of smaller, weaker, or less magnets in the device. In this case, nickel-plated or otherwise water and heat protected magnets should be used. Alternatively, wing 30 can be attached directly to a magnet that serves as a base.

The sides of base 15 may be made straight, convex, concave, wavy, etc.

Wing 30 may be placed off-center on base 15, or on an edge of base 15.

While the above description contains many specificities, these should not be construed as limitations on the scope of the invention, but as exemplifications of the presently preferred embodiments thereof. Many other ramifications and variations are possible within the teachings of the invention. For example, it can be made in many shapes and sizes to accommodate usage on various shapes, styles, and sizes of knives and be used with many different kinds, shapes, and styles of knives and other cutting tools, for use in the kitchen and elsewhere, as well as other utensils and scrapers. It can be used to corral many different kinds of food, as well as be used to corral and scrape things other than food, it may be used to assist in cleaning a knife blade after use, and may be used to scrape items other than knife blades.

Thus the scope of the invention should be determined by the appended claims and their legal equivalents, and not by the examples given.

What is claimed is:

1. A method of cleaning a knife, comprising:

(a) an object for removing one or more items removably stuck to the blade of a knife, said object comprising a single wing protruding from an elongated base, further including temporary attachment means for removable attachment to the blade of said knife, said temporary attachment means comprising at least one magnet, (b) said wing being shaped to allow angled cutting with said knife while said object is temporarily attached to said knife, (c) said object allowing the user to slide said object along the blade of said knife with one hand while grasping said knife with their other hand, (d) scraping said blade with said object for removing one or more items removably stuck to said blade of said knife whereby said one or more items removably stuck to said blade are removed from said blade.

2. The method of claim 1, wherein said temporary attachment means comprises at least one cavity formed within said elongated base and at least one magnet inserted into and secured substantially within said at least one cavity.

3. The method of claim 1, wherein said object comprises means for raising at least one portion of said knife off of a surface when said knife is placed on said surface.

4. The method of claim 1, wherein said at least one object is removably attached to at least one portion of said knife during use of said knife.

* * * * *